US012550962B2

(12) United States Patent
Ohayon et al.

(10) Patent No.: US 12,550,962 B2
(45) Date of Patent: Feb. 17, 2026

(54) PROTECTIVE HELMET WITH AN OPTIMIZED AERODYNAMIC DEFLECTOR

(71) Applicant: SHARK, Marseilles (FR)

(72) Inventors: David Ohayon, Aix-en-Provence (FR); Alban Rojas, Marseilles (FR)

(73) Assignee: SHARK, Marseilles (FR)

( * ) Notice: Subject to any disclaimer, the term of this patent is extended or adjusted under 35 U.S.C. 154(b) by 0 days.

(21) Appl. No.: 18/293,142

(22) PCT Filed: Jul. 19, 2022

(86) PCT No.: PCT/FR2022/051432

§ 371 (c)(1),
(2) Date: Feb. 24, 2025

(87) PCT Pub. No.: WO2023/007075

PCT Pub. Date: Feb. 2, 2023

(65) Prior Publication Data

US 2025/0194728 A1 Jun. 19, 2025

(30) Foreign Application Priority Data

Jul. 30, 2021 (FR) ..... 21/08328

(51) Int. Cl.
*A42B 3/04* (2006.01)
*A42B 3/22* (2006.01)

(52) U.S. Cl.
CPC ..... *A42B 3/0493* (2013.01); *A42B 3/22* (2013.01)

(58) Field of Classification Search
CPC ..... A42B 3/0493; A42B 3/281; A42B 3/22
See application file for complete search history.

(56) References Cited

U.S. PATENT DOCUMENTS 5,996,128 A * 12/1999 Yanagihara ..... A42B 3/281 2/425
7,574,754 B2 * 8/2009 Arai ..... A42B 3/0493 2/410
7,748,059 B2 * 7/2010 Arai ..... A42B 3/0493 2/424

(Continued)

FOREIGN PATENT DOCUMENTS

DE 3444404 C2 9/1987
DE 102012214061 A1 5/2014

(Continued)

OTHER PUBLICATIONS

International Search report for corresponding application PCT/FR2022/051432 filed Jul. 19, 2022; Mail date Oct. 31, 2022.

(Continued)

*Primary Examiner* — Khoa D Huynh
*Assistant Examiner* — Erick I Lopez
(74) *Attorney, Agent, or Firm* — CANTOR COLBURN LLP

(57) ABSTRACT

A protective helmet (1) comprising a cap (2) having a rear portion on which an aerodynamic deflector (3) is mounted, the protective helmet (1) being characterised in that at least one aerodynamic flap (4) is mounted so as to move freely on the aerodynamic deflector (3) in order to be able to be deployed by aerodynamic forces generated by an air flow. A favoured, non-limiting use of the invention is in the field of motorbike racing.

24 Claims, 4 Drawing Sheets

(56) References Cited

U.S. PATENT DOCUMENTS

2010/0229289 A1* 9/2010 Murakami ..... A42B 3/0493
2/425

FOREIGN PATENT DOCUMENTS

| | | | |
|---|---|---|---|
| EP | 1714568 | A1 | 10/2006 |
| EP | 1396200 | B1 | 12/2006 |
| EP | 2027787 | A1 | 2/2009 |
| WO | 8703457 | A1 | 6/1987 |

OTHER PUBLICATIONS

Written Opinion for corresponding International Application PCT/EN2022/051432 filed Jul. 19, 2022; Mail date Oct. 31, 2022.

* cited by examiner

PROTECTIVE HELMET WITH AN OPTIMIZED AERODYNAMIC DEFLECTOR

TECHNICAL FIELD

The invention relates to a protective helmet intended to equip a motorcyclist, and in particular a protective helmet comprising a cap having a rear part on which an aerodynamic deflector is mounted.

STATE OF THE ART

It is known, particularly in the field of motorcycling competition, to mount an aerodynamic deflector, sometimes called a «spoiler», at the rear of the helmet to reduce the effect of drag on the rear of the helmet. It is also known to combine such a helmet with a back hump, also called «hump», fixed to the pilot suit and which provides quasi-aerodynamic continuity with the aerodynamic deflector provided on the helmet.

The state of the art can thus be illustrated by documents EP 2 027 787, EP 3 138 429 and EP 1 396 200, which all describe this type of helmet with aerodynamic deflector.

The state of the art can also be illustrated by the teachings of document EP 1 714 568 which proposes a helmet provided with a cap on which is mounted an aerodynamic guide element whose position is adjustable by the user in a front/rear direction, and also following an inclination towards the wind, which corresponds to various driving postures.

It is moreover known from document DE 10 2012 214061 to provide, at the rear of a cycling helmet, an aerodynamic attachment tapered towards the rear for aerodynamic improvement, and at least one aerodynamic adapter placed on the aerodynamic attachment and which can be manually displaced by the cyclist between an engaged and disengaged position to modify the aerodynamism.

However, although a conventional aerodynamic deflector, whether fixed or previously adjusted by the user, is satisfactory in a straight line, the applicant has observed that the aerodynamic deflector could cause undesirable effects in certain situations, and in particular in turning situation, such as for example in the field of motorcycling competition where the turning speeds can be comprised between 80 and 160 km/h in so-called slow turns, or even between 160 and 250 km/h in so-called fast turns.

In fact, when turning, the driver leans his motorcycle at an angle of inclination classically comprised between approximately 50 and 65 degrees, and furthermore he adopts a swayed position by placing or almost placing his knee at the level of the track, while placing the head on the inside of the turn, inclined relative to the longitudinal axis of the motorcycle, to be able to fix the turn in the distance.

In this position, the helmet is both inclined laterally and at least partially offset from the windshield of the motorcycle, so that the direct air flow and the air flow returned by the windshield come to bear under strong pressure on the lateral side of the helmet, to the right or left depending on the direction of the turn. Under the effect of this strong lateral pressure, the aerodynamic deflector tends to bring the helmet back in the direction of the longitudinal axis of the motorcycle, according to a so-called «flag» effect or self-alignment in the wind axis. To counter this aerodynamic yaw moment, the pilot must compensate with his muscular force alone in order to keep his head tilted outside the protection of the windshield when turning, which is particularly restrictive and tiring for all the neck muscles and shoulders (triceps and trapezius in particular) as well as the cervical spine.

Moreover, the Applicant has observed that, in a straight line and at high speed, in particular above 300 km/h, the helmet and its aerodynamic deflector undergo a turbulent oscillation effect, which therefore results in a movement of oscillating yaw of the helmet and therefore of the wearer head, which is amplified by generating a phenomenon of aeroelastic resonance; in other words the yaw movement is amplified when combined with the muscular elasticity/rigidity of the pilot head.

SUMMARY OF THE INVENTION

The invention proposes to respond at least in part to the aforementioned problems, by proposing an aerodynamic deflector which combines the classic advantages of reducing drag, without the disadvantages of the aerodynamic moment when turning and the oscillating yaw movement in a straight line.

Thus, the invention proposes a protective helmet comprising a cap having a rear part on which is mounted an aerodynamic deflector, wherein at least one aerodynamic flap is movably mounted on said aerodynamic deflector, said protective helmet being remarkable in this at least one aerodynamic flap is mounted freely movable on the aerodynamic deflector between a retracted position and a deployed position, the aerodynamic flap thus being able to be deployed from the deployed position to the retracted position under the effect of aerodynamic forces generated by an air flow circulating along the cap and the aerodynamic deflector.

Thus, the invention proposes to mount one or more aerodynamic flaps on the aerodynamic deflector, so that the or each aerodynamic flap will be able to move according to aerodynamic constraints (direction of air flows, speed of air flows, flow shapes, etc.), and thus contribute to an adaptation of the flows at the level of the aerodynamic deflector.

In a driving situation, the at least one aerodynamic flap is mounted freely movable on the aerodynamic deflector, in order to be movable under the sole action of an air flow circulating along the cap and the aerodynamic deflector.

Thus, only aerodynamic constraints cause the or each aerodynamic flap to move, without the need for actuation. In other words, the or each aerodynamic flap provides an aerodynamic self-adaptation function.

Advantageously, the at least one aerodynamic flap is in the deployed position at rest, in the absence of air flow circulating along the cap and the aerodynamic deflector.

In a particular embodiment, the aerodynamic deflector has an external deflecting face which gradually moves away from the cap and the at least one aerodynamic flap does not project externally with respect to the external deflecting face of the aerodynamic deflector in the deployed position.

Advantageously, the at least one aerodynamic flap extends in the extension of the external deflecting face of the aerodynamic deflector in the deployed position to ensure aerodynamic continuity with the aerodynamic deflector.

Thus, when the or each aerodynamic flap is in the deployed position, in particular in a straight line situation, the aerodynamic deflector behaves like a conventional deflector without a flap, by offering a continuous deflector face.

According to another possibility, the at least one aerodynamic flap is folded down or brought closer towards the cap in the retracted position, compared to the deployed position, to open an air circulation passage, in particular in a turning situation.

According to one feature, at least one upper stop is provided on the aerodynamic deflector or on the at least one aerodynamic flap to stop said aerodynamic flap in the deployed position.

Thus, the aerodynamic flap cannot go beyond the deployed position, and therefore cannot project externally with respect to the aerodynamic deflector.

According to another feature, at least one lower stop is provided on the cap or on the at least one aerodynamic flap to stop said aerodynamic flap in the retracted position.

In a particular embodiment, the at least one aerodynamic flap is movable between the deployed position and the retracted position, and vice versa, in a continuous or progressive manner.

Thus, the or each aerodynamic flap ensures progressive, or continuous, aerodynamic adaptation to finely be adjusted to the conditions.

According to a possibility, the at least one aerodynamic flap is movable on the aerodynamic deflector at least pivotally along a pivot axis.

It is possible for the at least one aerodynamic flap to be movable only in pivoting, or to be movable in pivoting and translation (for example by means of an articulation which combines rotation and translation).

In an advantageous embodiment, the at least one aerodynamic flap has a front ridge facing the front of the helmet and a rear ridge facing the rear of the helmet, said front ridge being pivotally coupled to the aerodynamic deflector along the pivot axis and said rear ridge being free.

It is obvious that the front of the helmet corresponds to the part wherein the opening for the pilot face is provided (generally an opening provided with a screen or visor), and the rear of the helmet corresponds to the part where the aerodynamic deflector is located.

According to a characteristic, the aerodynamic flap is movable in pivoting on the aerodynamic deflector by means of an articulation element connecting the aerodynamic flap to the aerodynamic deflector.

According to another characteristic, the articulation element is selected from one of the following elements:

- a flexible membrane, for example made of an elastomeric material or a textile material:
- a mechanical hinge;
- an elastically deformable folding line, such as for example a line of reduced thickness.

Advantageously, the at least one aerodynamic flap is coupled to at least one elastic return element which urges the aerodynamic flap towards a return to the deployed position.

According to a possibility, the at least one elastic return element comprises a compressible element with elastic return, which is compressed by the aerodynamic flap when it is displaced towards the retracted position.

According to another possibility, the compressible element with elastic return is a spring or a layer of compressible material with elastic return, such as for example an elastomeric material or a foam.

In an advantageous embodiment, the at least one aerodynamic flap is movably mounted in an opening provided on the aerodynamic deflector.

According to one feature, the at least one aerodynamic flap closes the opening in the deployed position, and partially opens the opening in the retracted position.

According to another feature, the opening is delimited by rims and the at least one aerodynamic flap is adjacent to these rims in the deployed position, and is distant from at least one of these rims in the retracted position.

According to another characteristic, the aerodynamic deflector has a rear trailing edge, and the opening is provided in this rear trailing edge.

Advantageously, the at least one aerodynamic flap has a rear ridge which is free, and which forms a trailing ridge, this rear ridge of the aerodynamic flap coming in continuity with the rear trailing edge of the aerodynamic deflector in the deployed 5 position.

Thus, when in the deployed position, the or each aerodynamic flap and the aerodynamic deflector together define a continuous trailing line.

In an advantageous embodiment, the at least one aerodynamic flap comprises at least two aerodynamic flaps arranged on either side of a sagittal plane of the protective helmet, respectively on the right and on the left.

Thus, at least two aerodynamic flaps are positioned on the aerodynamic deflector, to the right and to the left, so that these lateral flaps can move to reduce the lateral pressure when turning both to the right and to the left. In fact, the strong lateral pressure tends to flatten the aerodynamic flap exposed to such pressure (depending on the turning direction), thus shortening the path on the lower surface, which tends to reduce drag and reduce the aerodynamic yaw moment. In this way, when turning, the effort is less for the driver to keep his head tilted out of the field of the windshield. This version with at least two lateral flaps therefore provides more comfort to the pilot and reduces energy expenditure, by reducing the «flag» effect of the aerodynamic deflector in turning position.

In a straight-line situation at high speed, these aerodynamic flaps will also be able to flap in an oscillating manner, thus compensating for the effect of turbulent oscillation experienced by the helmet and its aerodynamic deflector. In other words, in a straight-line position, these aerodynamic flaps can remain movable or may oscillate slightly to act as a turbulence damper at high speed.

According to one feature, the at least two aerodynamic flaps are independent in their respective mobilities.

In other words, these aerodynamic flaps are independent between the right and the left, so that their respective displacements will be adapted in situation, according to the aerodynamic constraints undergone by the helmet.

According to a possibility, the aerodynamic deflector has a central wall extended to the right and left, on either side of the sagittal plane, by two lateral walls, and the at least two aerodynamic flaps are movably mounted on the two respective lateral walls.

According to another possibility, the two lateral walls of the aerodynamic deflector are symmetrical with respect to the sagittal plane, and the at least two aerodynamic flaps are symmetrical with respect to the sagittal plane when they are in the deployed position.

According to another possibility, the at least two aerodynamic flaps have respective surface areas which are greater than or equal to 50% of the surface areas of the lateral walls of the aerodynamic deflector.

BRIEF DESCRIPTION OF THE FIGURES

Other characteristics and advantages of the present invention will appear on reading the detailed description below, of a non-limiting example of implementation, made with reference to the appended figures wherein.

DETAILED DESCRIPTION OF ONE OR MORE EMBODIMENTS OF THE INVENTION

Figure 1:
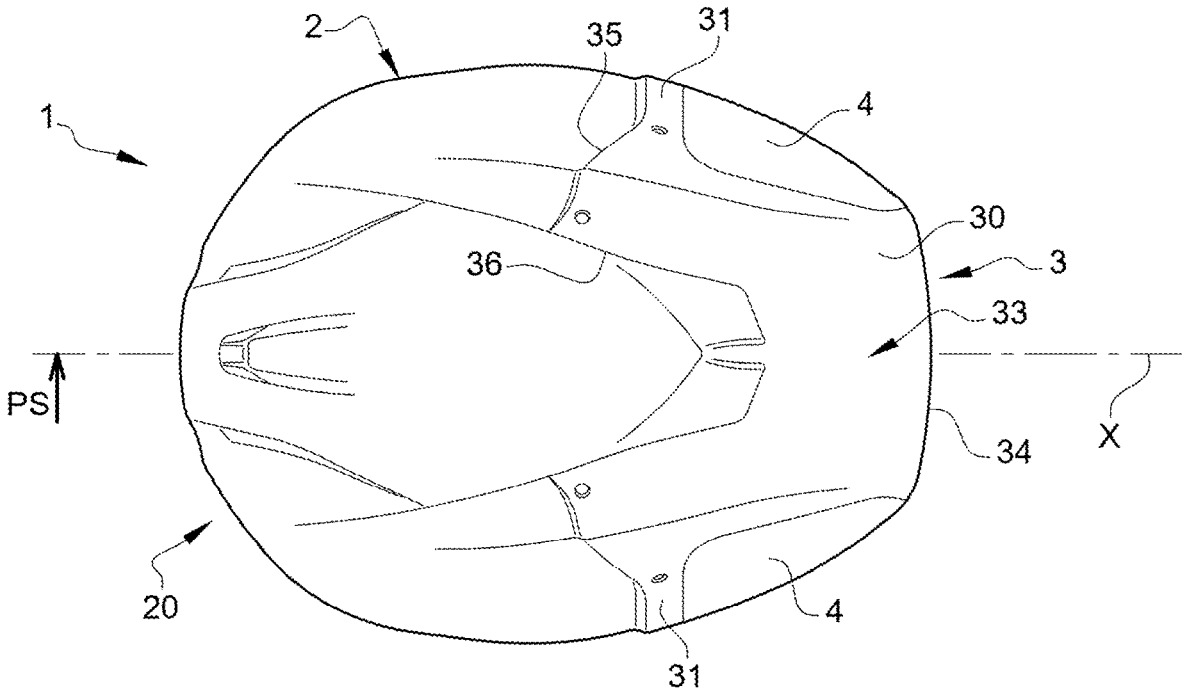
FIG. 1 is a schematic top view of a helmet according to an embodiment of the invention, with an aerodynamic deflector whose lateral flaps are in the deployed position.

With reference to the Figures, a protective helmet 1 according to an embodiment of the invention comprises a rigid cap 2 in the general shape of an open spherical cap, intended to be worn on the head of a wearer and to protect it. This cap 2 has a front part 20 having an opening for the wearer face, such a front part 20 being able to be equipped with a screen 22 and possibly a chin guard 23. This cap 2 also has a rear part 21 on which is mounted an aerodynamic deflector 3. The helmet 1 has a sagittal plane PS which extends vertically along the length of the helmet 1 and which divides the helmet 1 into right part and left part.

Figure 2:
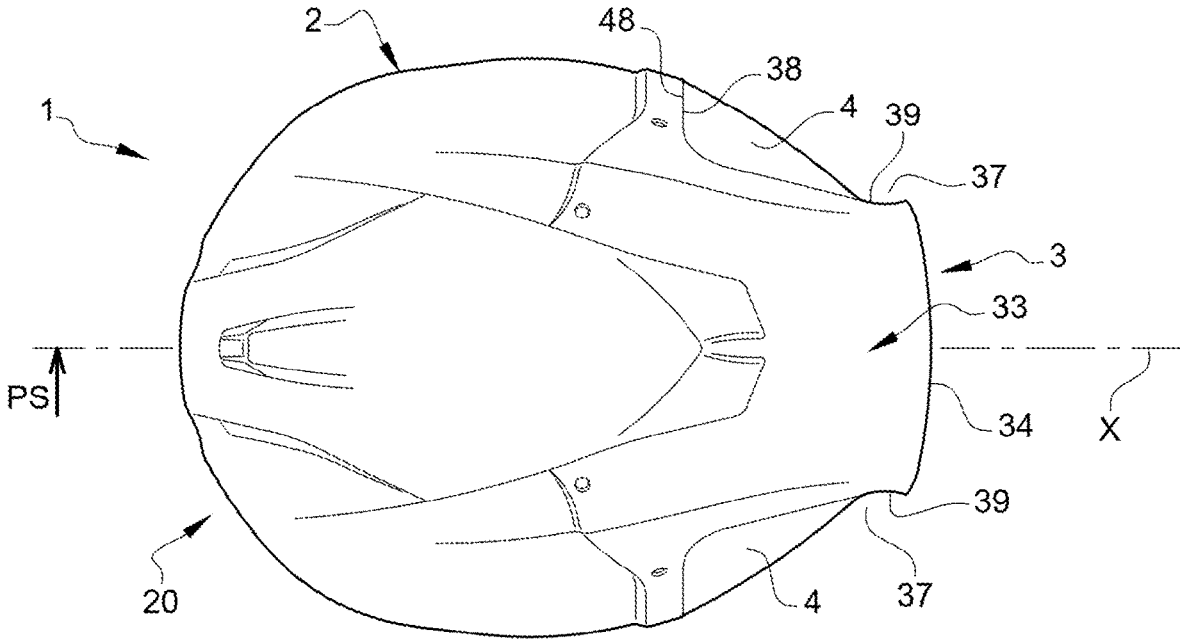
FIG. 2 is a schematic top view of the helmet in FIG. 1, with an aerodynamic deflector whose lateral flaps are in the retracted position.

This aerodynamic deflector 3 is fixed on the rear part 21 of the cap 2 statically, for example by screwing or any other means of fixing, whether removable or not. The aerodynamic deflector 3 has a central wall 30 extended to the right and left, on either side of the sagittal plane, by two lateral walls 31: these two lateral walls 31 being symmetrical with respect to the sagittal plane PS of the helmet 1. The aerodynamic deflector 3 has an external deflecting face 33 which gradually moves away from the cap 2, and also has an opposite internal face which faces the cap 2. The aerodynamic deflector 3 has a rear trailing edge 34 (possibly curved), as well as a front edge 35 pressed against the cap 2. As visible in FIGS. 1 and 2, this front edge 35 can have a notch 36 at the level of its central wall 30, centered on the sagittal plane PS of the helmet 1, so as to allow a flow partially under the central wall 30 of the aerodynamic deflector 3. On the other hand, the front edge 35 is pressed against the cap 2 at the level of the two lateral walls 31.

According to the invention, at least one aerodynamic flap 4 is movably mounted on this aerodynamic deflector 3, and more precisely in the illustrated example, two aerodynamic flaps 4 are movably mounted on the aerodynamic deflector 3. The two aerodynamic flaps 4 are movably mounted on the two respective lateral walls 31 of the aerodynamic deflector 3, with therefore an aerodynamic flap 4 on the right and an aerodynamic flap 4 on the left and thus arranged on either side of the sagittal plane PS.

Each aerodynamic flap 4 is movably mounted in an opening 37 provided on the corresponding lateral wall 31 of the aerodynamic deflector 3, where this opening 37 is provided in the rear trailing edge 34. Thus, the aerodynamic deflector 3 has two openings 37 provided in the two respective lateral walls 31, and each opening 37 is in the form of a notch in the rear trailing edge 34. Each opening 37 is delimited by rims, including a front rim 38 and at least one lateral rim 39 (two lateral rims 39 in the illustrated example).

Figure 3:
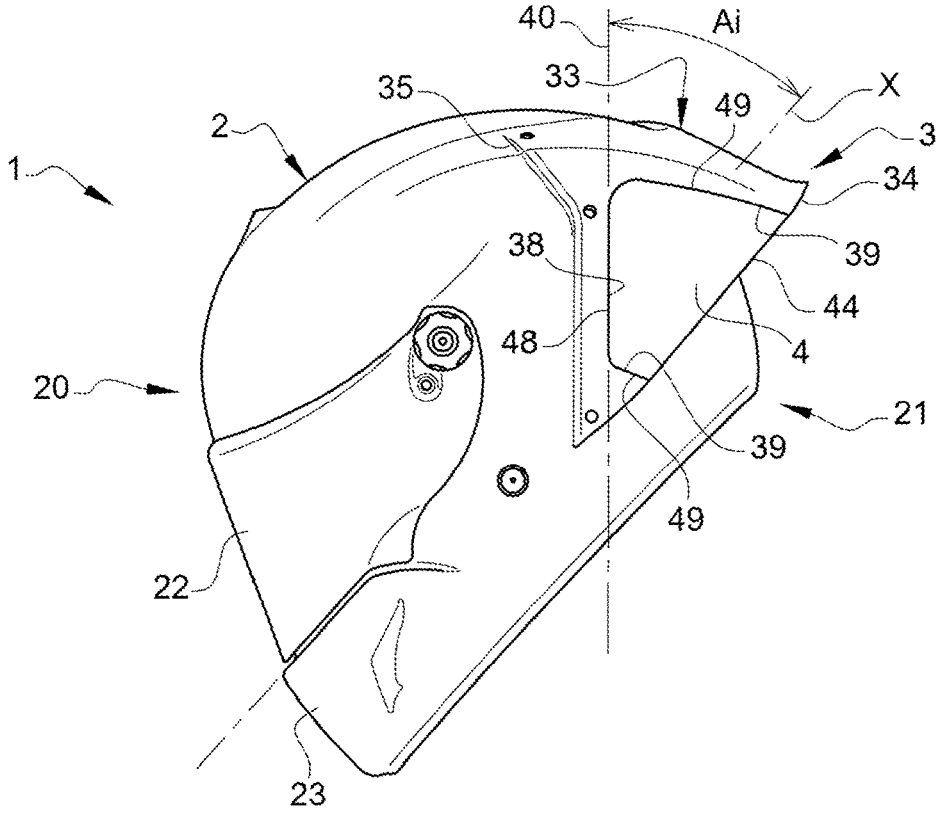
FIG. 3 is a schematic side view of the helmet in FIG. 1, with the lateral flaps in the deployed position.
Figure 4:
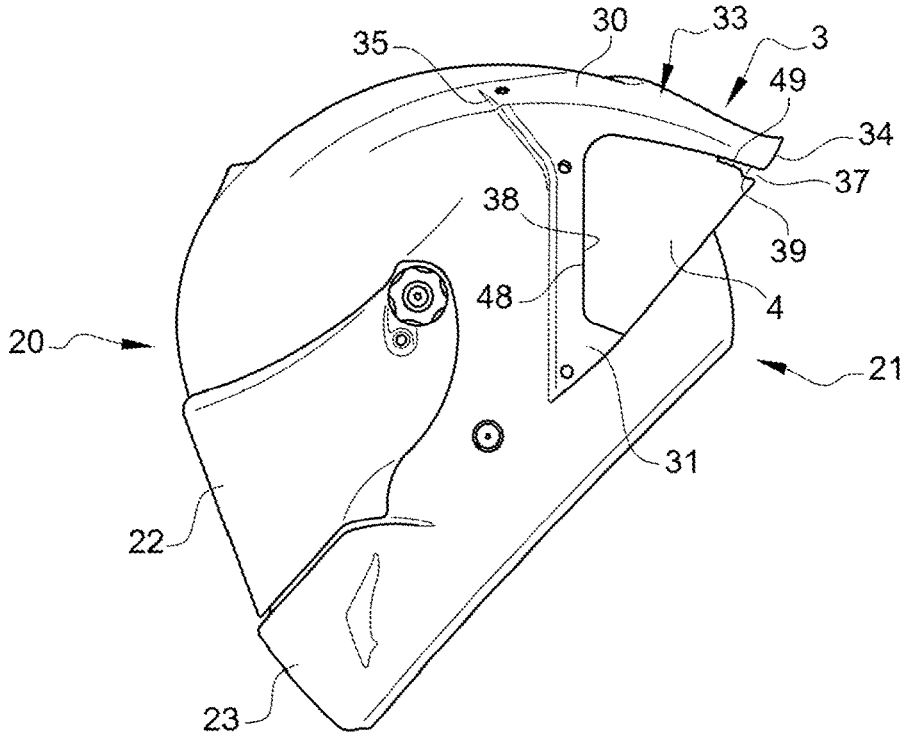
FIG. 4 is a schematic side view of the helmet in FIG. 1, with the lateral flaps in the retracted position.
Figure 5:
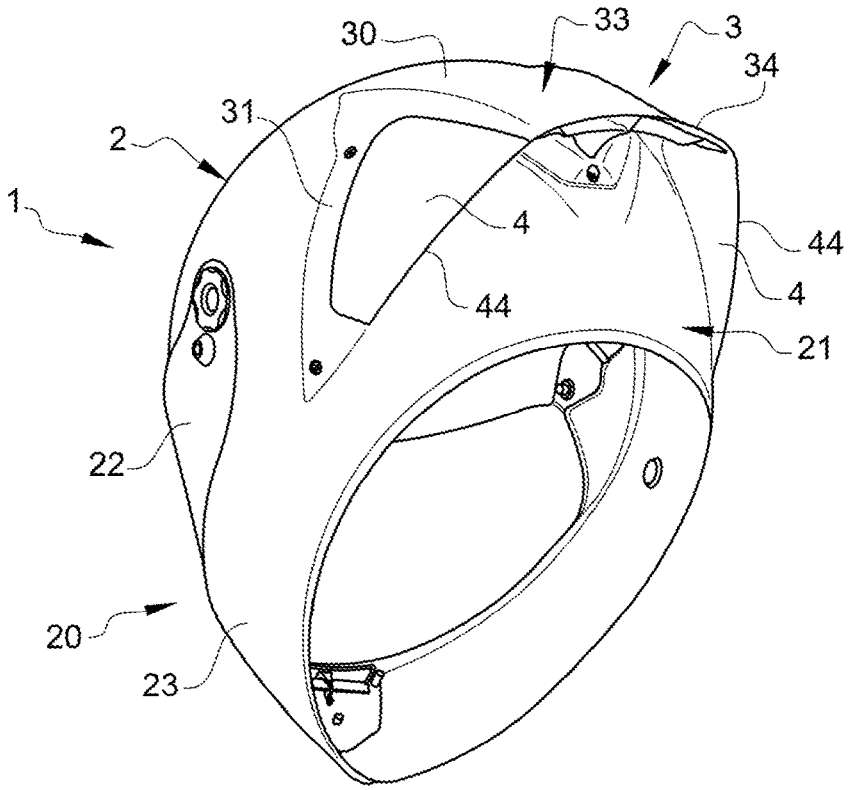
FIG. 5 is a schematic rear perspective view of the helmet in FIG. 1, with the lateral flaps in the deployed position.
Figure 6:
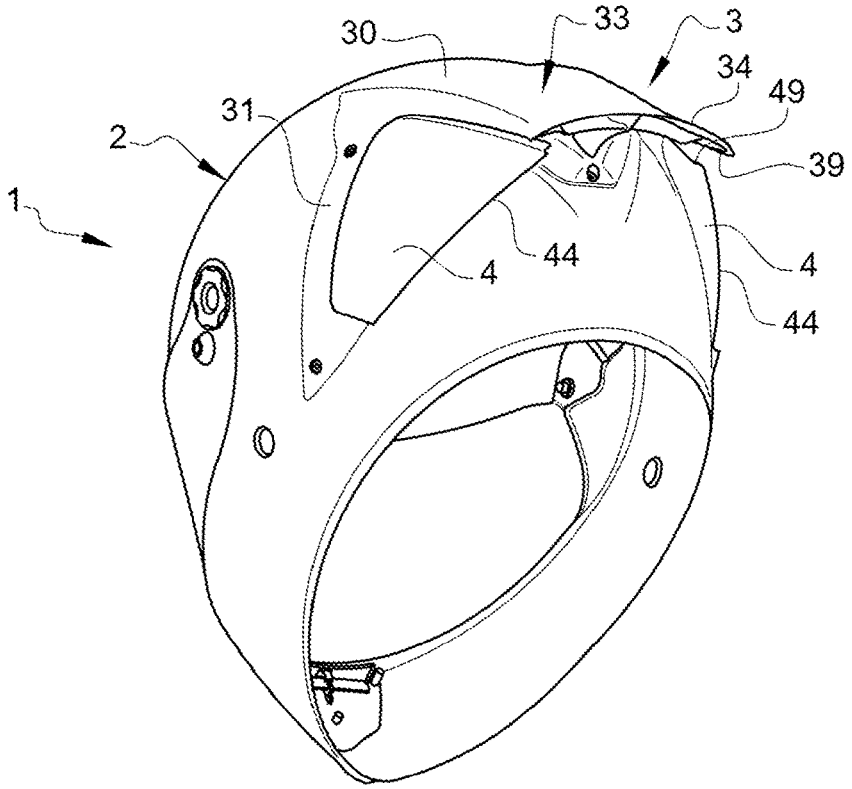
FIG. 6 is a schematic rear perspective view of the helmet in FIG. 1, with the lateral flaps in the retracted position.
Figure 7:
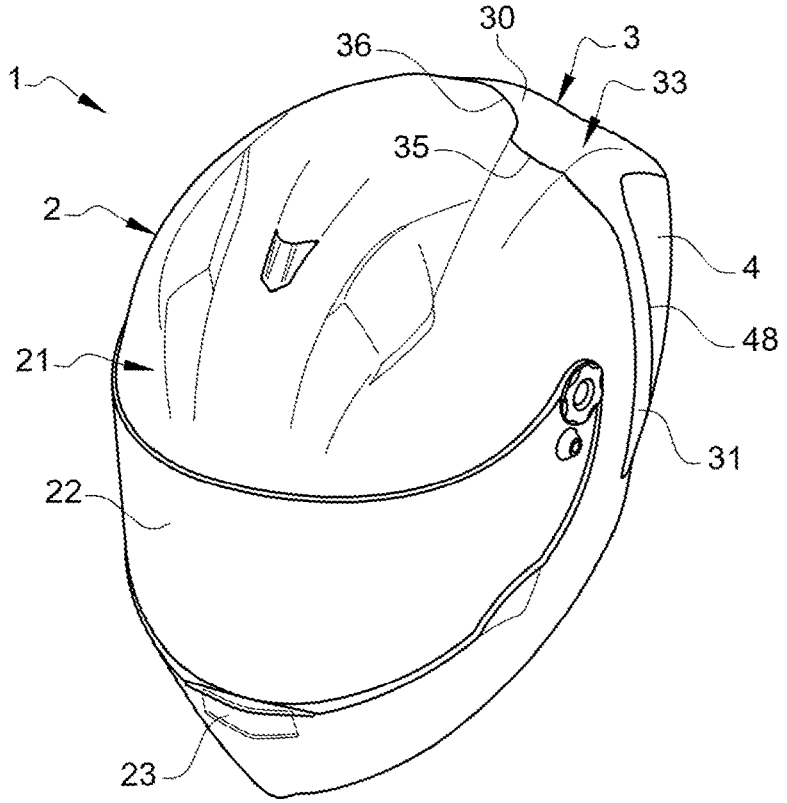
FIG. 7 is a schematic front perspective view of the helmet of FIG. 1, with the lateral flaps in the deployed position.
Figure 8:
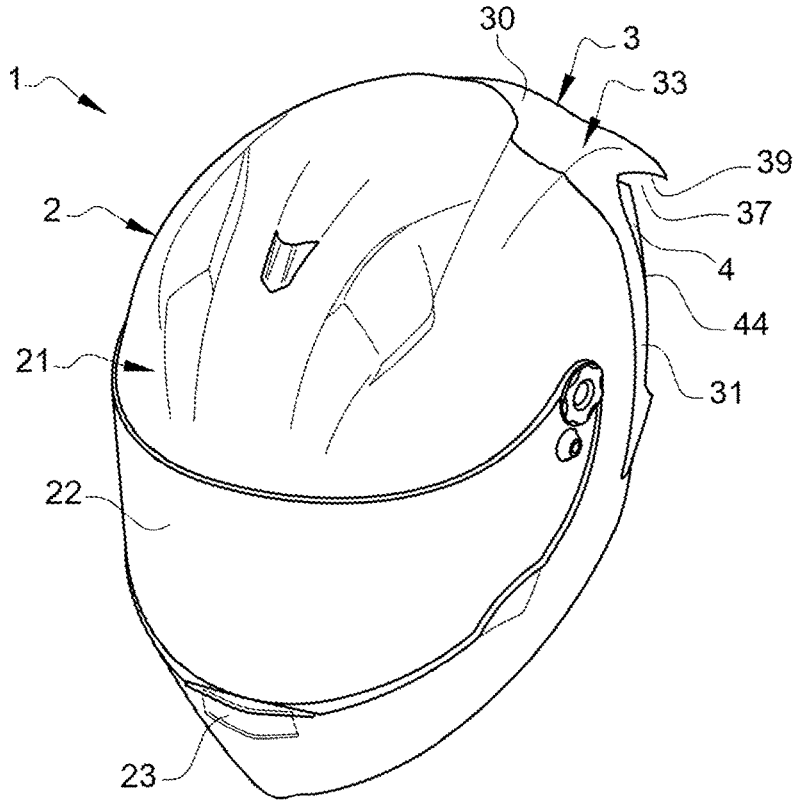
FIG. 8 is a schematic front perspective view of the helmet in FIG. 1, with the lateral flaps in the retracted position.

Each aerodynamic flap 4 is movable on the corresponding lateral wall 31 in pivoting along a pivot axis 40. More precisely, each aerodynamic flap 4 has a front ridge 48 facing the front of the helmet 1 and a rear ridge 44 facing the rear of the helmet 1, as well as at least one lateral ridge 49 joining the front ridge 48 to the rear ridge 44, and the front ridge 48 is pivotally coupled to the front rim 38 of the opening 37 of the corresponding lateral wall 31 along the pivot axis 40. The rear ridge 44 is free and forms a trailing ridge. The at least one lateral ridge 49 is also free. As visible in FIG. 3, the pivot axis 40 has an angle of inclination AI comprised between 20 and 90 degrees relative to a longitudinal direction X of the helmet 1, and in particular an angle comprised between 30 and 70 degrees or even between 30 and 50 degrees: the longitudinal direction X being defined here as a horizontal direction, comprised in the sagittal plane PS, when the helmet 1 is placed flat on a horizontal surface.

The front ridge 48 is coupled or pivotally movable on the corresponding lateral wall 31 by means of an articulation element (not shown) connecting the front ridge 48 of the aerodynamic flap 4 to the front rim 38 of the opening 37 of the corresponding lateral wall 31. This articulation element can be a flexible membrane, for example made of an elastomeric material or a textile material, which joins the front ridge 48 of the aerodynamic flap 4 to the front rim 38, and the pivoting is done by deformation or folding of this flexible membrane. Alternatively, this articulation element can be a mechanical hinge comprising two knuckles mechanically coupled in rotation by a physical axis of rotation, such knuckles being fixed respectively on the front ridge 48 of the aerodynamic flap 4 and on the front rim 38 of the concerned opening 37. In another variant, this articulation element can be an elastically deformable folding line, such as for example a line of lesser thickness, formed in a continuous material between the aerodynamic flap 4 and the aerodynamic deflector 3, so that this aerodynamic flap 4 and this aerodynamic deflector 3 are made in a single unit or in one piece.

It should be noted that each aerodynamic flap 4 is mounted freely movable on the aerodynamic deflector 3 and that these two aerodynamic flaps 4 are independent in their respective mobilities, in order to be movable independently under the sole action of a circulating air flow along the cap 2 and the aerodynamic deflector 3. In addition, each aerodynamic flap 4 has a surface area which is greater than or equal to 50%, or even greater than or equal to 65%, of the surface area of the corresponding lateral wall 31 of the aerodynamic deflector 3.

Each aerodynamic flap 4 is therefore movable between a retracted position (visible in FIGS. 2, 4, 6 and 8) and a deployed position (visible in FIGS. 1, 3, 5 and 7), each aerodynamic flap 4 is deployed from the deployed position towards the retracted position under the effect of aerodynamic forces generated by an air flow circulating along the cap 2 and the aerodynamic deflector 3. Moreover, each aerodynamic flap 4 is movable between the deployed position and the retracted position, and vice versa, in a continuous or progressive manner, in other words smoothly.

Each aerodynamic flap 4 is in the deployed position at rest, in the absence of air flow circulating along the cap 2 and the aerodynamic deflector 3. Also, and although not illustrated, it is advantageous for each aerodynamic flap 4 to be coupled to at least one elastic return element which urges the aerodynamic flap 4 towards a return to the deployed position. Such an elastic return element can for example comprise a compressible element with elastic return, which is compressed by the aerodynamic flap 4 when it moves towards the retracted position; this compressible element with elastic return being, by way of illustrative and non-limiting example, a spring or a layer of compressible material with elastic return, such as an elastomeric material or a foam.

As visible in FIGS. 1, 3, 5 and 7, when in the deployed position, each aerodynamic flap 4 does not project externally with respect to the external deflecting face 33 of the aerodynamic deflector 3, and more precisely each aerodynamic flap 4 extends in the extension of the external deflecting face 33 to ensure aerodynamic continuity with the aerodynamic deflector 3. Thus, in the deployed position, each aerodynamic flap 4 closes the corresponding opening 37, so that the aerodynamic flap 4 is contiguous with the rims 38, 39 of the opening 37. In other words, in the deployed position, the or each lateral ridge 49 of the aerodynamic flap 4 is adjacent to the lateral rim(s) 39 of the opening 37. Moreover, in the deployed position, the rear ridge 44 of the aerodynamic flap 4 is in continuity with the rear trailing edge 34 of the aerodynamic deflector 3. It should be noted that the two aerodynamic flaps 4 are symmetrical with respect to the sagittal plane PS when they are in the deployed position.

Although not illustrated, it is advantageous to provide, for each aerodynamic flap 4, at least one upper stop on the aerodynamic deflector 3 or on the aerodynamic flap 4 to stop the aerodynamic flap 4 in the deployed position, so that it does not project externally from the external deflecting face 33. By way of non-limiting example, such an upper stop can be in the form of a recess at the level of a lateral ridge 49 of the aerodynamic flap 4, capable of coming to rest against the corresponding lateral rim 39 of the opening 37.

As visible in FIGS. 2, 4, 6 and 8, when in the retracted position, each aerodynamic flap 4 is folded down or brought closer towards the cap 2, compared to the deployed position, to open an air circulation passage below of the aerodynamic deflector 3. In other words, in the retracted position, each aerodynamic flap 4 has pivoted (relative to the deployed position) so that the rear ridge 44 has moved closer to the cap 2. Thus, in the retracted position, each aerodynamic flap 4 partially opens the corresponding opening 37, so that the aerodynamic flap 4 is moved away from the lateral rim(s) 39 of the opening 37. In other words, in the retracted position, the or each lateral ridge 49 of the aerodynamic flap 4 is offset downwards (in the direction of the cap 2) relative to the lateral rim(s) 39 of the opening 37. Moreover, in the retracted position, the rear ridge 44 of the aerodynamic flap 4 has passed under the trailing rear edge 34 of the aerodynamic deflector 3. Although not illustrated, it is advantageous to provide, for each aerodynamic flap 4, at least one lower stop on the cap 2 or on the aerodynamic flap 4 to stop the aerodynamic flap 4 in the retracted position.

The invention claimed is:

1. A protective helmet comprising a cap having a rear part on which is mounted an aerodynamic deflector, wherein at least one aerodynamic flap is movably mounted on said aerodynamic deflector, wherein the at least one aerodynamic flap is mounted freely movable on the aerodynamic deflector between a retracted position and a deployed position, the at least one aerodynamic flap thus being able to be deployed from the deployed position to the retracted position under the effect of aerodynamic forces generated by an air flow circulating along the cap and the aerodynamic deflector.

2. The protective helmet according to claim 1, wherein the at least one aerodynamic flap is configured to be in the deployed position at rest, in the absence of air flow circulating along the cap and the aerodynamic deflector.

3. The protective helmet according to claim 1, wherein the aerodynamic deflector has an external deflecting face which gradually moves away from the cap, and the at least one aerodynamic flap does not project externally with respect to the external deflecting face of the aerodynamic deflector in the deployed position.

4. The protective helmet according to claim 3, wherein the at least one aerodynamic flap extends in an extension of the external deflecting face of the aerodynamic deflector in the deployed position to ensure aerodynamic continuity with said aerodynamic deflector.

5. The protective helmet according to claim 1, wherein the at least one aerodynamic flap is folded down or brought closer towards the cap in the retracted position, compared to the deployed position, to open an air circulation passage.

6. The protective helmet according to claim 1, wherein the at least one aerodynamic flap is movable between the deployed position and the retracted position, and vice versa, in a continuously progressive manner.

7. The protective helmet according to claim 1, wherein the at least one aerodynamic flap is movable on the aerodynamic deflector at least pivotally along a pivot axis.

8. The protective helmet according to claim 7, wherein the pivot axis has an angle of inclination (Al) comprised between 30 and 90 degrees relative to a longitudinal direction of the protective helmet.

9. The protective helmet according to claim 7, wherein the at least one aerodynamic flap has a front ridge facing the front of the protective helmet and a rear ridge facing the rear of the helmet, said front ridge being pivotally coupled to the aerodynamic deflector along the pivot axis and said rear ridge being free.

10. The protective helmet according to claim 7, wherein the at least one aerodynamic flap is pivotally movable on the aerodynamic deflector by means of an articulation element connecting the at least one aerodynamic flap to the aerodynamic deflector.

11. The protective helmet according to claim 10, wherein the articulation element is selected from one of the following elements:

a flexible membrane made of an elastomeric material or a textile material:

a mechanical hinge;

an elastically deformable folding line.

12. The protective helmet according to claim 1, wherein the at least one aerodynamic flap is coupled to at least one elastic return element which urges the at least one aerodynamic flap towards a return in the deployed position.

13. The protective helmet according to claim 12, wherein the at least one elastic return element comprises a compressible element with elastic return, which is compressed by the at least one aerodynamic flap when it is displaced in the direction of the retracted position.

14. The protective helmet according to claim 13, wherein the compressible element with elastic return is a spring or a layer of compressible material with elastic return.

15. The protective helmet according to claim 1, wherein the at least one aerodynamic flap is movably mounted in an opening provided on the aerodynamic deflector.

16. The protective helmet according to claim 15, wherein the at least one aerodynamic flap closes the opening in the deployed position, and partially opens the opening in the retracted position.

17. The protective helmet according to claim 15, wherein the opening is delimited by rims and the at least one aerodynamic flap is adjacent to these rims in the deployed position, and is away from at least one of these rims in the retracted position.

18. The protective helmet according to claim 15, wherein the aerodynamic deflector has a rear trailing edge, and the opening is formed in said rear trailing edge.

19. The protective helmet according to claim 18, wherein the at least one aerodynamic flap has a rear ridge which is free and which forms a trailing ridge, said rear ridge of the at least one aerodynamic flap coming in continuity with the rear trailing edge of the aerodynamic deflector in the deployed position.

20. The protective helmet according to claim 1, wherein the at least one aerodynamic flap comprises at least two aerodynamic flaps arranged on either side of a sagittal plane of the protective helmet, respectively on a right side of the protective helmet and on a left side of the protective helmet.

21. The protective helmet according to claim 20, wherein the at least two aerodynamic flaps are independent in their respective mobility.

22. The protective helmet according to claim 20, wherein the aerodynamic deflector has a central wall extended to the right and to the left, on either side of the sagittal plane, by two lateral walls, and the at least two aerodynamic flaps are movably mounted on the two respective lateral walls.

23. The protective helmet according to claim 22, wherein the two lateral walls of the aerodynamic deflector are symmetrical with respect to the sagittal plane, and the at least two aerodynamic flaps are symmetrical with respect to the sagittal plane when they are in the deployed position.

24. The protective helmet according to claim 20, wherein the at least two aerodynamic flaps have respective surface areas which are greater than or equal to 50% of the surface areas of the lateral walls of the aerodynamic deflector.

* * * * *